US010196837B2

(12) United States Patent
Holmes et al.

(10) Patent No.: US 10,196,837 B2
(45) Date of Patent: Feb. 5, 2019

(54) CERAMIC SPINE SECURITY CABLE

(71) Applicant: Schlage Lock Company LLC, Carmel, IN (US)

(72) Inventors: Douglas A. Holmes, Golden, CO (US); Daniel H. Kindstrand, Tucson, AZ (US); Jonah S. Eidman, Astoria, NY (US); Gideon Hou, Milpitas, CA (US); Thomas Y. Liu, White Plains, NY (US); Ryan T. Stolz, Bellmore, NY (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 15/693,608

(22) Filed: Sep. 1, 2017

(65) Prior Publication Data

US 2018/0058106 A1 Mar. 1, 2018

Related U.S. Application Data

(60) Provisional application No. 62/382,379, filed on Sep. 1, 2016.

(51) Int. Cl.
*E05B 73/00* (2006.01)
*E05B 71/00* (2006.01)
(Continued)

(52) U.S. Cl.
CPC ..... *E05B 73/0005* (2013.01); *E05B 15/1614* (2013.01); *E05B 67/003* (2013.01); *E05B 71/00* (2013.01)

(58) Field of Classification Search
CPC .... E05B 73/0005; E05B 67/003; E05B 71/00; E05B 15/1614
(Continued)

(56) References Cited

U.S. PATENT DOCUMENTS 1,276,117 A * 8/1918 Riebe ..... F16C 1/26 138/120
1,380,720 A 6/1921 Johnson
(Continued)

FOREIGN PATENT DOCUMENTS

EP 1527986 A2 5/2005

OTHER PUBLICATIONS

International Search Report; International Searching Authority; International Patent Application No. PCT/US2017/049828; dated Dec. 5, 2017; 2 pages.
(Continued)

*Primary Examiner* — Lloyd A Gall
(74) *Attorney, Agent, or Firm* — Taft Stettinius & Hollister LLP

(57) ABSTRACT

A cable lock including a lock body having a locking mechanism with a locked state and an unlocked state. A ceramic body cable includes a plurality of nested ceramic bodies and a cord, wherein each one of the plurality of ceramic bodies includes a center portion having an aperture. Each aperture of the plurality of nested ceramic bodies forms a channel through which the cord is positioned. Each of the ceramic bodies also includes a projection and a space such that the projection of one of the ceramic bodies overlaps the space of an adjacent ceramic body. A mesh sleeve is positioned on an exterior of the ceramic body cable and a shrunken heat shrinkable tube is positioned over the mesh sleeve. The combined ceramic body cable, mesh sleeve, and shrunken heat shrinkable tube are coupled to the lock body.

22 Claims, 10 Drawing Sheets

(51) Int. Cl.
*E05B 15/16* (2006.01)
*E05B 67/00* (2006.01)

(58) Field of Classification Search
USPC ..... 70/14, 18, 30, 49, 53, 58, 233, 417
See application file for complete search history.

(56) References Cited

U.S. PATENT DOCUMENTS 1,539,301 A 5/1925 Cooper
1,545,660 A * 7/1925 Johnson ..... E05B 69/003 70/18
1,772,453 A 8/1930 Bosworth
3,696,647 A 10/1972 Balicki
3,765,196 A 10/1973 Balicki
3,841,118 A 10/1974 Stone
3,933,015 A 1/1976 Balicki
4,561,272 A 12/1985 Goldstein
4,719,773 A * 1/1988 Alberts ..... E05B 73/0005 70/18
4,831,849 A * 5/1989 Kortenbrede ..... E05B 67/003 70/417
4,944,168 A * 7/1990 Kortenbrede ..... E05B 67/003 70/417
5,236,527 A * 8/1993 Brodsky ..... B29C 63/42 156/85
5,274,353 A 12/1993 Bianchi
5,406,810 A 4/1995 Chen
5,889,463 A * 3/1999 Judd ..... B60R 25/1001 340/425.5
6,016,673 A 1/2000 McDaid
6,026,664 A * 2/2000 Lin ..... E05B 67/003 70/18
6,109,074 A * 8/2000 Du ..... E05B 67/003 70/18
6,430,973 B1 * 8/2002 Huang ..... B62H 5/003 70/18
7,784,313 B2 * 8/2010 Wyers ..... E05B 67/003 70/14
8,429,940 B2 4/2013 Evans
9,243,428 B1 1/2016 Miracle
2005/0092038 A1 5/2005 Becker
2005/0183475 A1 8/2005 Liu
2007/0084255 A1 * 4/2007 Otto ..... B68B 1/14 70/16
2012/0210993 A1 8/2012 Baekelandt et al.
2014/0290314 A1 * 10/2014 Poehlmann ..... E05B 71/00 70/18
2015/0315821 A1 11/2015 Zuraski et al.
2016/0024818 A1 * 1/2016 Allen ..... E05B 67/003 70/30
2016/0199880 A1 * 7/2016 George ..... E06B 9/02 428/446
2016/0201356 A1 * 7/2016 George ..... E06B 9/02 70/38 R
2016/0201357 A1 * 7/2016 George ..... E05B 67/063 70/38 R

OTHER PUBLICATIONS

Written Opinion; International Searching Authority; International Patent Application No. PCT/US2017/049828; dated Dec. 5, 2017; 4 pages.

* cited by examiner

CERAMIC SPINE SECURITY CABLE

CROSS REFERENCE TO RELATED APPLICATIONS

This application claims the benefit of U.S. Provisional Patent Application Ser. No. 62/382,379 filed Sep. 1, 2016, the contents of which are hereby incorporated by reference in their entirety.

FIELD OF THE INVENTION

The present disclosure relates to a security device, and more particularly to a security cable lock for securing movable items such as bicycles, motorbikes, scooters, lawn equipment, outdoor furniture, and other items.

BACKGROUND

Lightweight transportation vehicles can be stolen due to the ease with which the vehicles can be removed from where the vehicle is stored or parked. In particular, bicycles are often subject to theft since a bicycle can simply be ridden away if not properly stored or protected. To reduce or eliminate the risk of theft of such vehicles, a wide variety of locks have been proposed, including U-locks and cable locks.

A U-lock typically includes a semi-enclosure member or shackle having legs or fittings with configured feet, a straight crossbar having openings for reception of the feet, and a locking mechanism in the crossbar for retaining or releasing the feet. A cable lock typically includes a relatively flexible cable having at one end a leg or fitting with a configured foot and a lock housing extending from the other end of the cable. The lock housing includes an opening for reception of the foot, and a locking mechanism in the lock housing to releasably retain the foot. For protection against theft, either of the locks can be used to couple a bicycle frame to a suitable object, such as a post, rail, rack or station. Once the U-lock or cable lock couples the bicycle frame to the suitable object, the lock is locked to prevent or reduce the likelihood of theft of the bicycle.

While both U-locks and cable locks are capable of securing a bicycle to a suitable object, neither of these types of locks provide complete protection against a thief having unlimited time and/or tools. For instance, some types of locks provide little protection when exposed to a thief having certain kinds of tools that are capable of breaking the lock housing, breaching or cutting the shackle, or cutting the cable of a cable lock.

U-locks and cable locks are not only used to secure bicycles, but are also used to secure other types of vehicles such as, for example, motorbikes, motorcycles, scooters, four wheelers, and other vehicles used for transportation. U-locks and cable locks are also used to secure items having value which are often stored outdoors such as, for example, lawn furniture, propane tanks, and gas grills. Any movable item having value can be prone to theft. What is therefore needed is a cable lock which provides an increased level of security for these and other items that are subject to theft.

SUMMARY

The present invention is directed to a cable lock for securing an item to prevent or to reduce the likelihood of theft of an item. The cable lock includes a cable having nested ceramic segments arranged on a cord or rope made of a metal wire or other materials.

In one embodiment there is provided a cable lock including a lock body with a locking mechanism having a locked state and an unlocked state, and a plurality of ceramic bodies. Each of one of the plurality of ceramic bodies includes a center portion having an aperture and a plurality of projections extending from the center portion, wherein each of the ceramic bodies is adjacently located and the plurality of projections of one of the plurality of ceramic bodies overlaps the center portion of each of two adjacently located ceramic bodies. A cord extends through the aperture of each of the plurality of adjacently located ceramic bodies and is operatively connected to the lock body.

In another embodiment there is provided a cable lock including a lock body having a locking mechanism, wherein the locking mechanism has a locked state and an unlocked state, and a ceramic body cable. The ceramic body cable includes a plurality of nested ceramic bodies and a cord, and wherein each one of the plurality of ceramic bodies includes a center portion having an aperture. The apertures of the plurality of nested ceramic bodies form a channel through which the cord is located. A mesh sleeve is located on an exterior of the ceramic body cable and a shrunken heat shrinkable tube located over the mesh sleeve.

In still another embodiment there is provided a method of forming a cable lock including providing a plurality of ceramic elements, a cord, a mesh sleeve, a heat shrinkable tube, and a lock body. The method further includes the steps of threading the cord through the plurality of ceramic elements to form a ceramic body cable, threading the ceramic body cable through the mesh sleeve, threading the mesh sleeve and ceramic body cable through the heat shrinkable tube, shrinking the heat shrinkable tube about the mesh sleeve, and connecting the combined ceramic body cable, mesh sleeve, and shrunken heat shrinkable tube to the lock body.

DETAILED DESCRIPTION OF ILLUSTRATIVE EMBODIMENTS

Figure 1:
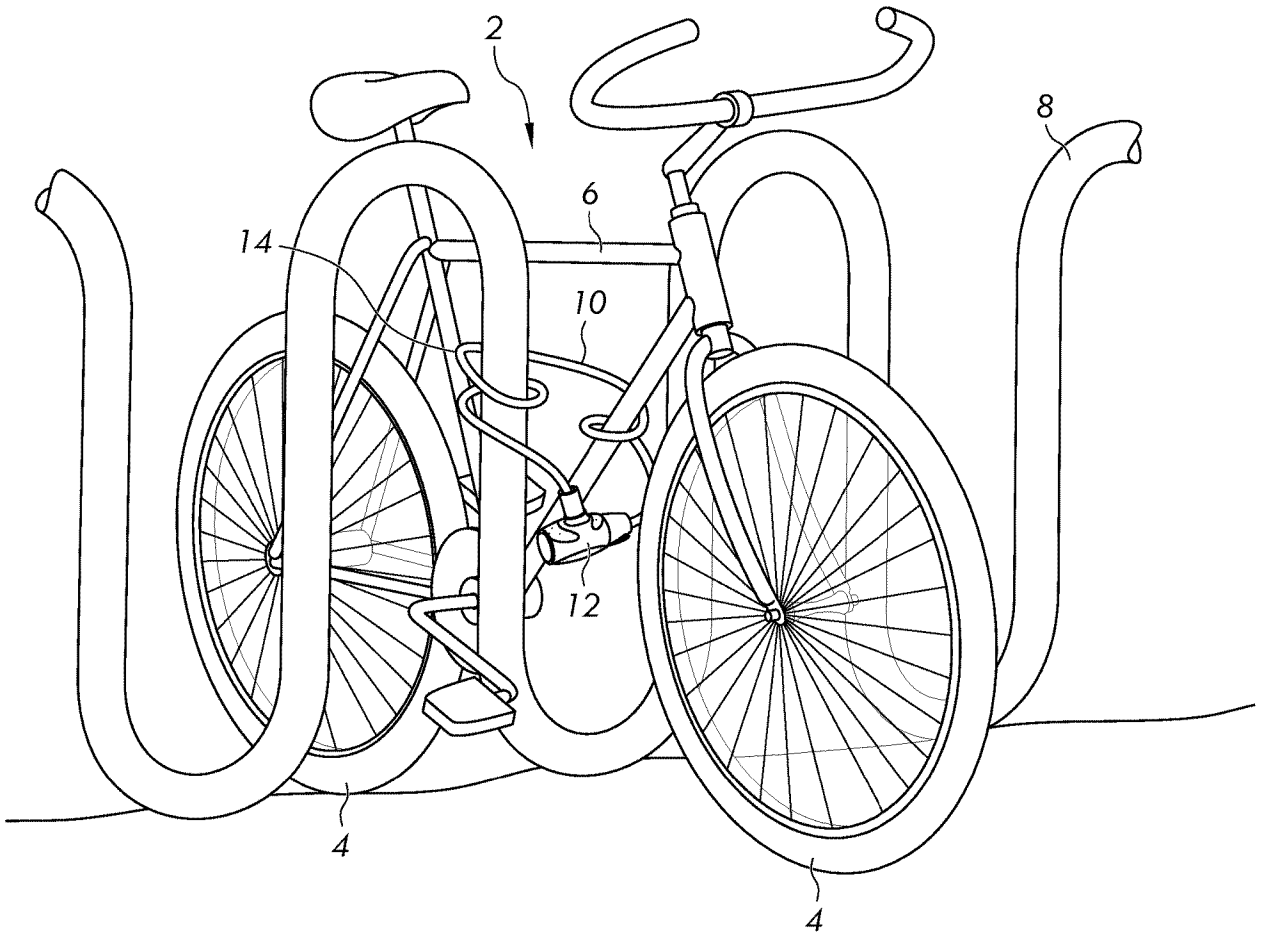
FIG. 1 is a perspective view of a bicycle secured to a bicycle rack with a cable lock.

For the purposes of promoting an understanding of the principles of the invention, reference will now be made to the embodiments illustrated in the drawings where specific language is used to describe the same. It should be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 illustrates a perspective view of a bicycle 2 having wheels 4 supported by a frame 6. The bicycle frame 6 is secured to a bicycle rack 8 with a cable lock 10. The cable lock 10 includes a lock head 12 coupled to a lock cable 14. To lock the bicycle 2 to the rack 8, the lock cable 14 is wrapped around the rack 8 and the frame 6 to secure the frame 6 to the rack 8. While locking the frame 6 to the rack 8 is illustrated in the figures, the illustrated method of securing the bicycle is only one possibility. The user of the bicycle 2 generally determines the best method of locking and many other methods are used and known. In addition, more than one lock can be used and locks of the same type or different types are often utilized.

Figure 2:
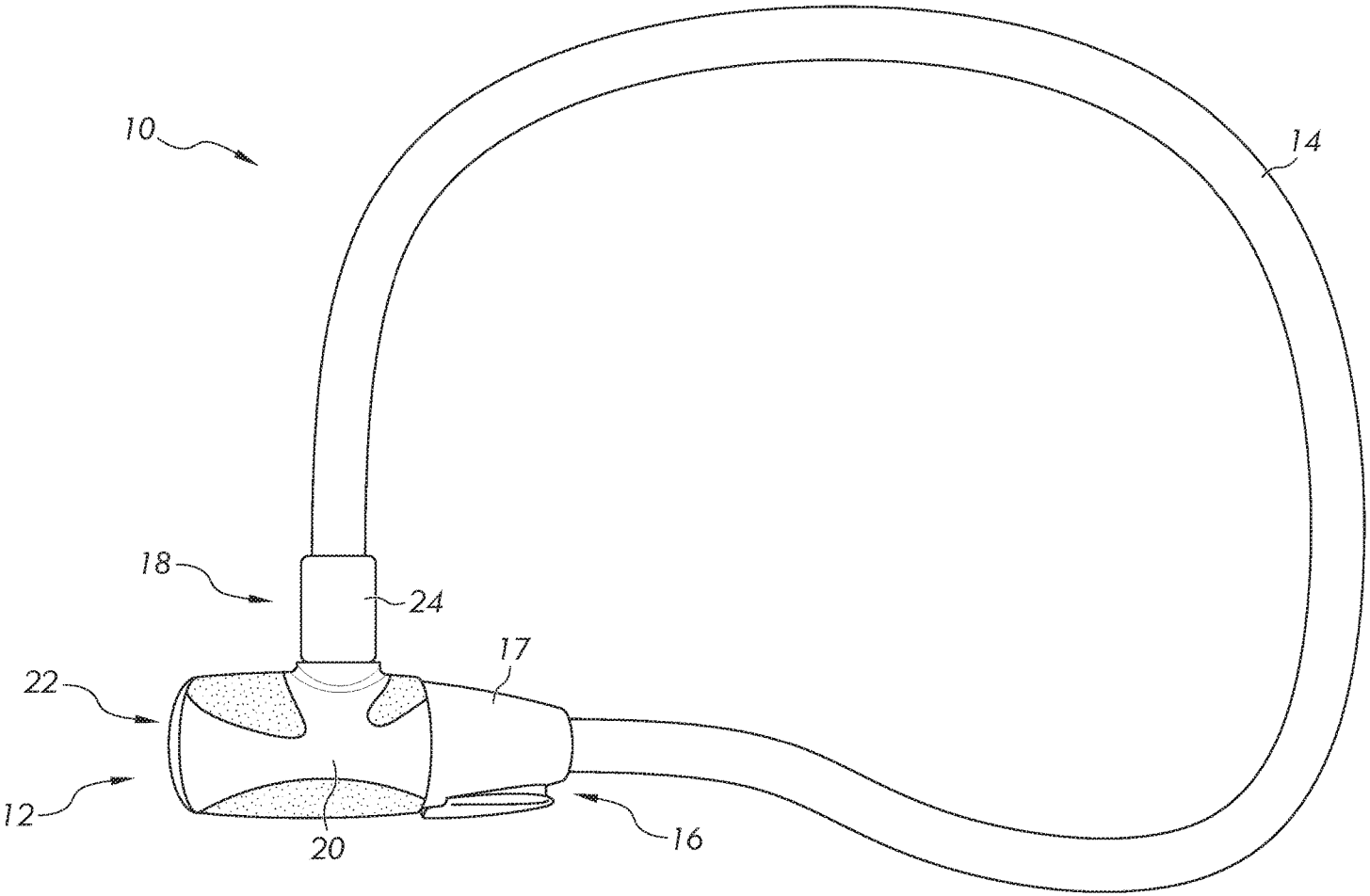
FIG. 2 is a plan view of a cable lock including a lock housing and a cable releasably coupled to the lock housing.

FIG. 2 illustrates a plan view of the cable lock 10 including the lock head 12 coupled to the lock cable 14. The lock cable 14 includes a first end 16 fixedly coupled to the lock head 12 and a second end 18 releasably coupled to the lock head 12. The first end 16 is fixedly connected to a collar 17 which is part of the lock head 12. The second end 18 is inserted into a lock housing 20 and held securely to the lock head 12 when locked by a lock mechanism (not shown). An end 22 of the lock head 12 includes a keyhole (not shown) configured to receive a key for locking and unlocking the lock mechanism. In other embodiments, the lock head 12 includes a combination lock. In different embodiments, the combination lock includes a rotating dial, rotating discs, an electronic keypad or a mechanical keypad, as is understood by those skilled in the art. In still other embodiments, the lock head includes an electronic lock responsive to a key fob. The second end 18 of the lock cable 14 includes a collar 24 which holds a locking pin, not shown. The locking pin is inserted into the lock mechanism and held securely to the lock head 12 when the lock is locked. In the unlocked condition, the locking pin is removed from the lock mechanism to free the second end 18 of the lock cable 14 from the housing 20.

Figure 3:
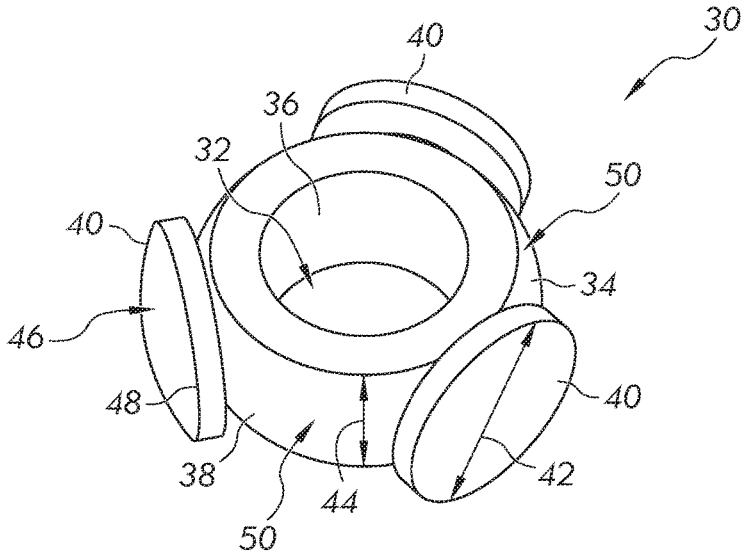
FIG. 3 is a perspective view of a ceramic segment.

The lock cable 14 includes a plurality of segments or bodies located on a cord or rope which is placed through each of the plurality of segments. FIG. 3 illustrates one embodiment of a segment 30 which includes a bore 32 through which the rope is located. The segment 30 includes a band or ring 34, also called a center portion, having a circular inner surface 36. In different embodiments, the band 34 is a circular band or other shapes. The ring further includes an outer surface 38 which is curved from top to bottom from which extends a plurality of projections 40.

As disclosed herein the segments are formed of relatively hard material including a ceramic material. The ceramic material includes, but is not limited to, a crystalline or non-crystalline material, such as silicon carbide, boron oxide, silicon nitride, born carbide, and tungsten carbide-cobalt. In addition, the segments, in different embodiments, are formed of composite materials having a ceramic matrix, such as embedded ceramic fibers.

Each of the plurality of projections 40 is generally disc shaped and includes a diameter 42 having a length greater than a height 44 of the ring 34. The projections 40 are centrally located along the ring 34 such that a portion of the projection 40 extends above the ring 34 and a portion of the projection 40 extends below the ring 34. The projection 40 also includes a convex surface 46 having a central area extending further from the surface 38 of the ring 34 than does a circular edge 48 of the projection 40.

The segment 30 in the embodiment of FIG. 3 includes three of the projections 40. The projections 40 are equally spaced about the outer surface 38 of the ring 34 to define a space 50 located between each of the projections 40. The space 50 includes a lateral dimension which is sufficiently sized to accommodate a portion of the projection of an adjacent segment as illustrated in FIG. 4.

Figure 4:
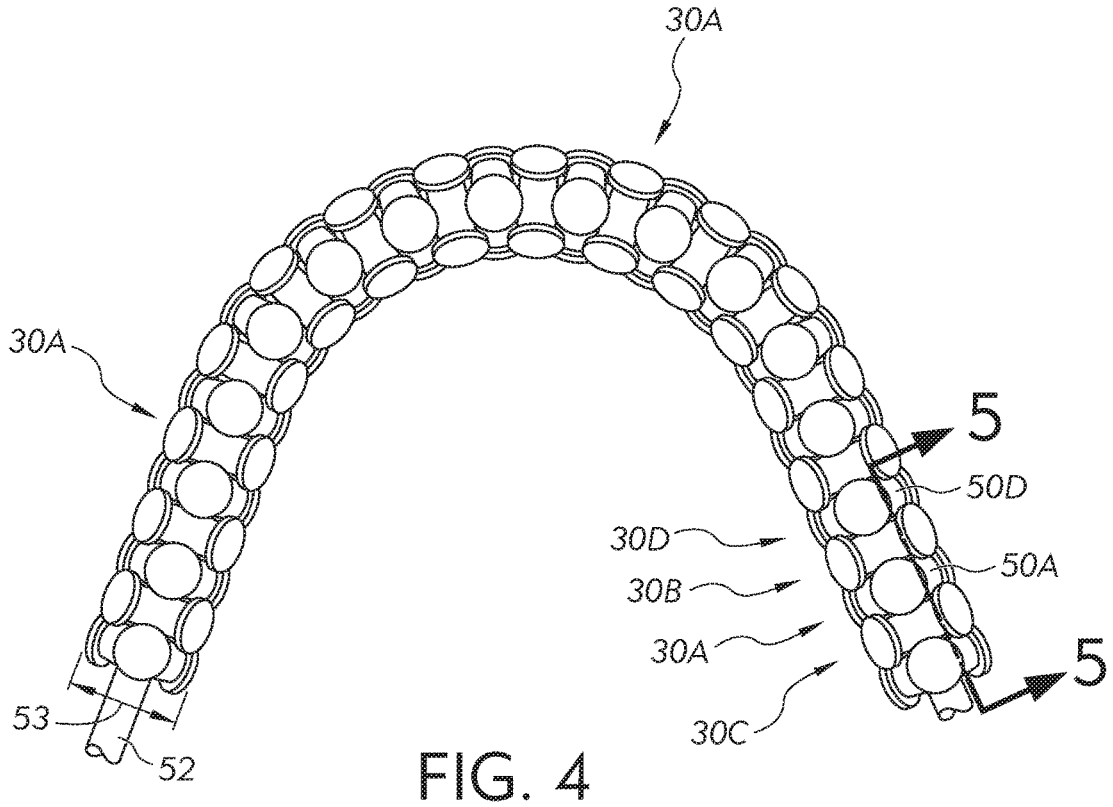
FIG. 4 is a perspective view of a plurality of the nested ceramic segment of FIG. 3.
Figure 5:
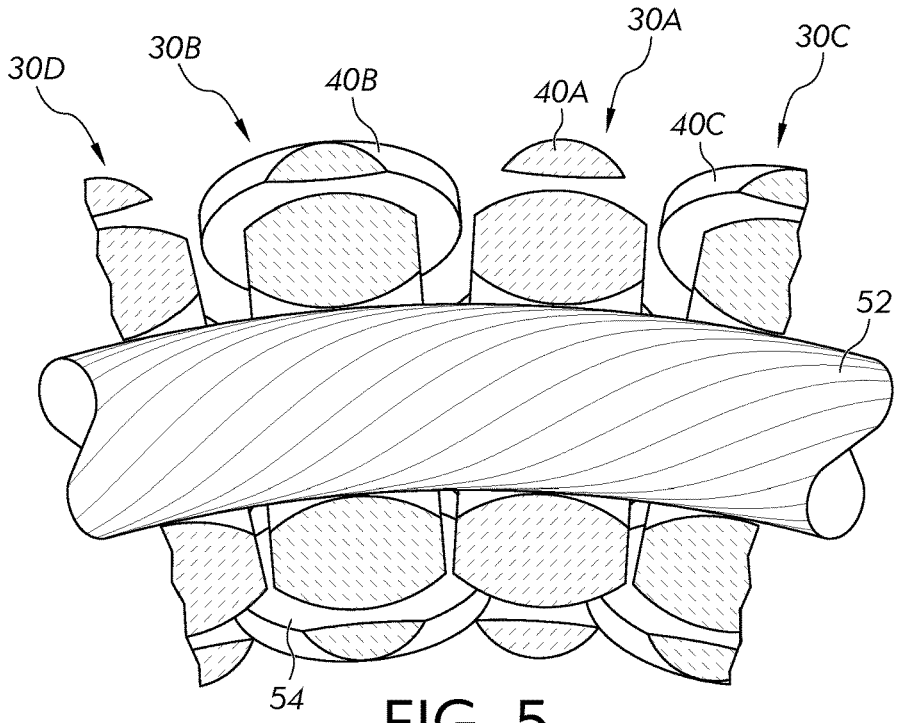
FIG. 5 is a cross-sectional view of a few of the plurality of the nested ceramic segments of FIG. 4.

As shown in FIGS. 4 and 5, a rope or cord 52 extends through the bore 32 of each of the segments 30. Each one of a plurality of the segments 30 is located next to another segment 30, such that one of the segments 30 nests with an adjacent segment 30. For instance a segment 30A is located between a segment 30B and a segment 30C. Segment 30D is located adjacent to segment 30B. The projections 40, of one of the segments, overlaps with the adjacent space 50 of an adjacent segment 30. For example, a projection 40B extends over and overlaps the space 50A and extends over and overlaps the space 50D such that each of segments 30 are nested with an adjacent segment 30 on one or both sides. In one embodiment, each of the plurality of segments 30 is substantially similar. In different embodiments, the rope includes a threaded cable, a braided cable, a woven cable, and a twisted cable. In one embodiment, the cable is a seven by seven twisted cable made of seven individual wires braided to form a single wire part and seven of these wire parts braided together. In one embodiment, the combined rope 52 and segments 30 include an outside diameter 53 of from about 10.0 to 12.00 millimeters. Other diameters of different sizes are also possible.

To accommodate nesting of adjacent segments 30, each of the segments 30 is rotated a predetermined amount with respect to an adjacent segment 30 to overlap a space with a projection. In the segment 30, as shown in the embodiment of FIG. 3, the segment 30 includes three of the projections 40 such that the amount of rotation with an adjacent segment is approximately 60 degrees. In other embodiments of the segments having other numbers of projections, the amount of relative rotation is determined based on the number of projections. For instance, in a segment having two projections, the amount of relative rotation between adjacent segments is 90 degrees. In a segment having four projections, the amount of relative rotation between adjacent segment is 45 degrees.

FIG. 5 illustrates a cross-sectional view of a few of the plurality of the nested ceramic segments of FIG. 3. In this embodiment, the rope 52 is bent such that a projection 40B extends over and into the adjacent spaces 50A and 50D, but does not contact the surfaces defining the spaces 50A and 50D. Sufficient bending of the rope 52 places the projections 40 into contact with an adjacent space 50 of an adjacent segment 30 on an inside curve of the cable. Consequently, the amount of curve of the cable is limited by contact of an inside surface 54 of a projection 40. In this and other embodiments, the rope is approximately 3 to 4 millimeters in diameter. Other diameters are also possible.

Figure 6:
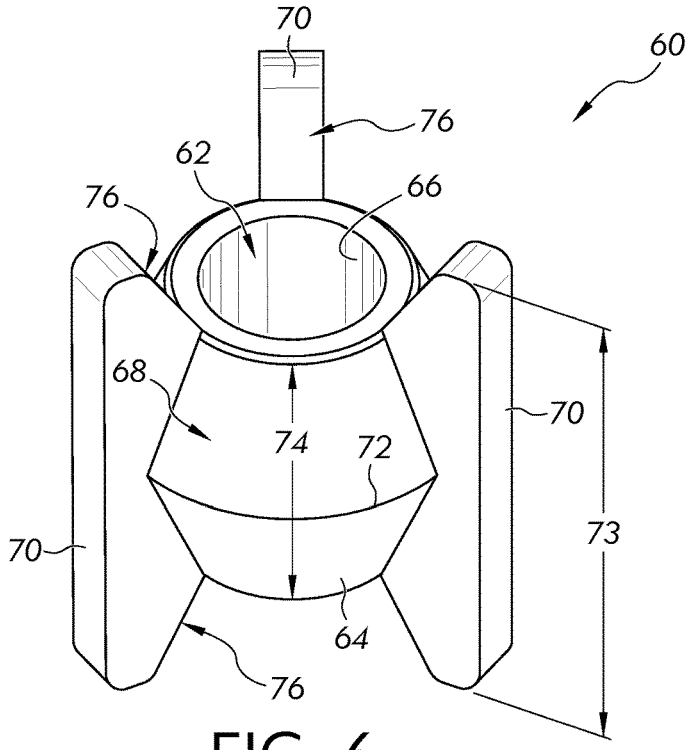
FIG. 6 is a perspective view of another ceramic segment.

FIG. 6 illustrates another embodiment of a segment 60 which includes a bore 62 through which the rope is located. The segment 60 includes a circular band or ring 64 having a circular cylindrical inner surface 66 which is generally flat from top to bottom of the segment. The ring further includes an outer surface 68 which is curved from top to bottom from which extends a plurality of projections 70. In this embodiment, the surface 68 does not include a continuous curvature, but is instead divided into two surfaces divided by a centerline 72. The centerline 72 defines a diameter with a central axis of the bore 62 which is greater than a diameter of terminating edges of the surface 68. Consequently, the surfaces extending away from the centerline 72 are inclined toward the bore 62.

Each of the plurality of projections 70 is generally fin shaped and includes a height 73 having a length greater than a height 74 of the ring 64. The projections 70 are centrally located about a circumferential center defined by a central axis extending lengthwise along the segment 60, such that a portion of the projections 70 extends above the centerline 72 and a portion of the projections 70 extends below the centerline 72. The projection 70 also includes surfaces 76 which extend away from and are inclined with respect to the central axis of the bore 62. In one embodiment, the angle of inclination of the surfaces 76 away from the bore is substantially the same as the angle of inclination of each of the surfaces on either side of the centerline 72 of the surface 68.

The segment 60 in the embodiment of FIG. 6 includes three of the projections 70. The projections 70 are equally spaced about the outer surface 68 of the ring 64 to define a space located between each of the projections 70. The space includes a lateral dimension which is sufficiently sized to accommodate a projection of an adjacent segment as illustrated in FIGS. 7 and 8.

Figure 7:
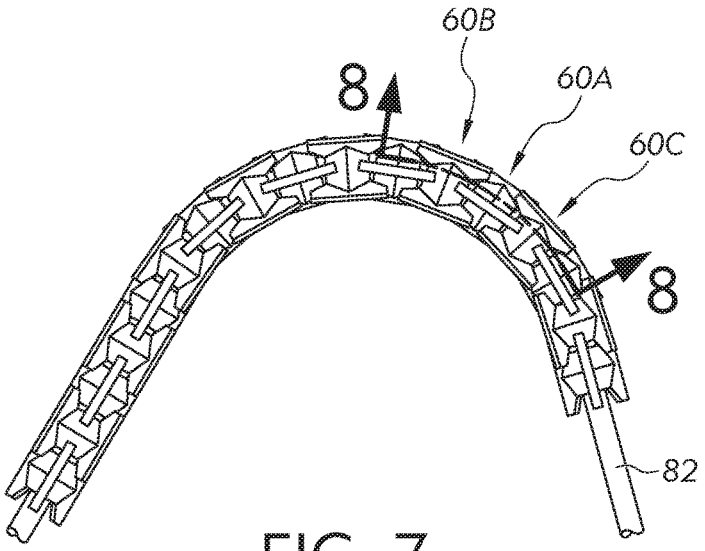
FIG. 7 is a perspective view of a plurality of the nested ceramic segments of FIG. 6.

As shown in FIG. 7, a rope or cord 82 extends through the bore 62 of each of the segments 60. Each one of a plurality of the segments 60 is located next to another segment 60, such that one of the segments 60 nests with an adjacent segment 60. For instance a segment 60A is located between a segment 60B and a segment 60C. The projection 70 of one of the segments overlaps with the adjacent space of an adjacent segment 60. For example, a projection 70A extends over and overlaps the space of segment 60B and extends over and overlaps the space of segment 60C such that the each of segments 60 is nested with an adjacent segment 60 on one or both sides. The segments 60 and cord 82 form a ceramic body cable.

To accommodate nesting of adjacent segments 60, each of the segments 60 is rotated a predetermined amount with an adjacent segment 60 to align the projections with a space. In the embodiment of FIG. 6 of the segment 60 having three of the projections 70, the amount of rotation is approximately 60 degrees. In other embodiments of segments having other numbers of projections, the amount of relative rotation is determined based on the number of projections. For instance, in a segment having two projections, the amount of relative rotation between adjacent segments is 90 degrees. In a segment having four projections, the amount of relative rotation is 45 degrees.

Figure 8:
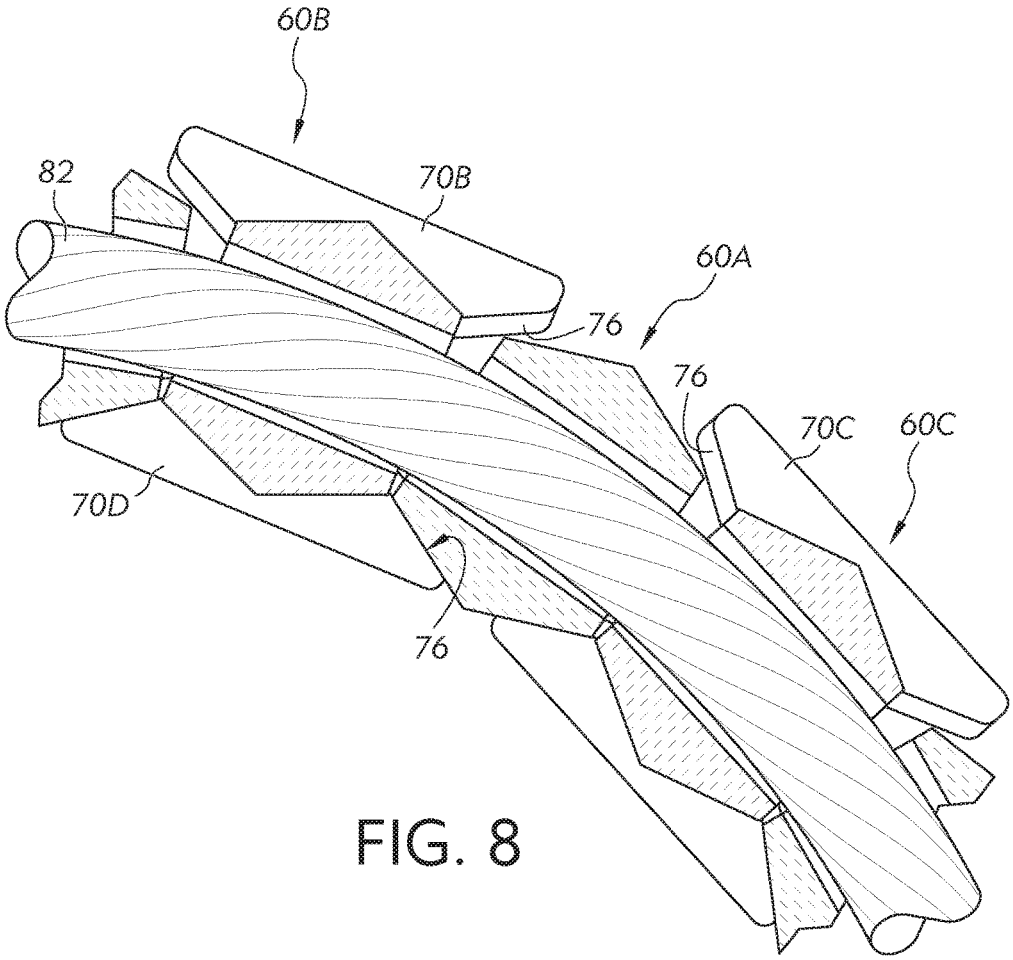
FIG. 8 is a cross-sectional view of a few of the plurality of nested ceramic segments of FIG. 7.

FIG. 8 illustrates a cross-sectional view of a few of the plurality of the nested ceramic segments of FIG. 7. In this embodiment, the rope 82 is bent such that a projection 70B extends over, but does not contact the surface defining the adjacent space of segment 60A and a projection 70C also extends over, but does not contact the surface defining the space of segment 60A. Sufficient bending of the rope 82, however places the projection 70D into contact with a surface defining an adjacent space, or bearing surface, of the adjacent segment 60A on an inside curve of the rope 82. Consequently, the amount of curve of the cable is limited by contact of an inside surface or contact surface 76 of a projection 70.

Figure 9:
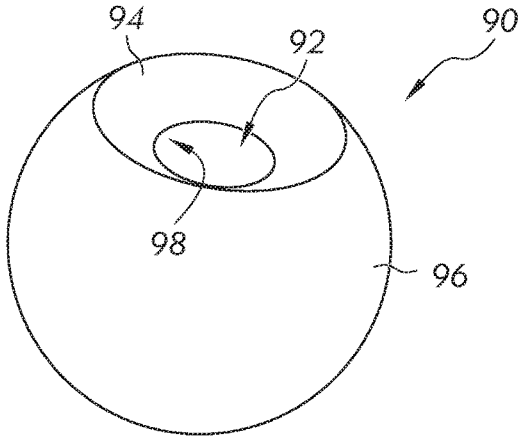
FIG. 9 is a perspective view of another ceramic segment.

FIG. 9 is a perspective view of another ceramic segment 90. In this embodiment, the segment 90 includes a bore 92 through which the rope is located. The segment 90 is generally spherical and includes an inclined bearing surface 94 which extends from an outer spherical surface 96 of the segment 90 to an inner surface 98 of the bore 92. The inclined surface 94 is inclined with a central axis of the bore 92 such that the surface is generally concave and extends into the segment 90. The angle of inclination of the surface 94 is based on the curvature of the surface 96 to provide an interface between the inclined surface 94 of one segment 90 with the exterior surface 96 of an adjacent segment 90. The portion of the segment that defines the inclined bearing surface may be referred to herein as a bearing portion.

Because the surface 96 is generally spherical, the surface 96 lacks areas which could provide access points for tools used to cut through the lock cable. Consequently, a cutting tool tends to skip off of the spherical surface toward an interface located between adjacent segments. The interface, however, provides a spherical surface of one segment located beneath a spherical surface of the adjacent segment to provide two layers of protective surfaces.

Figure 10:
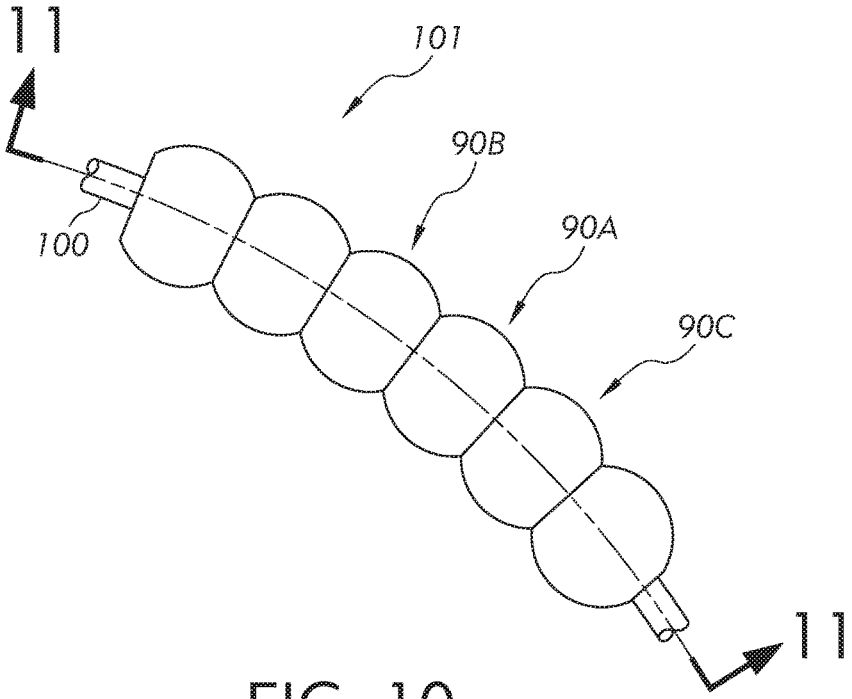
FIG. 10 is a perspective view of a plurality of the nested ceramic segments of FIG. 9.
Figure 11:
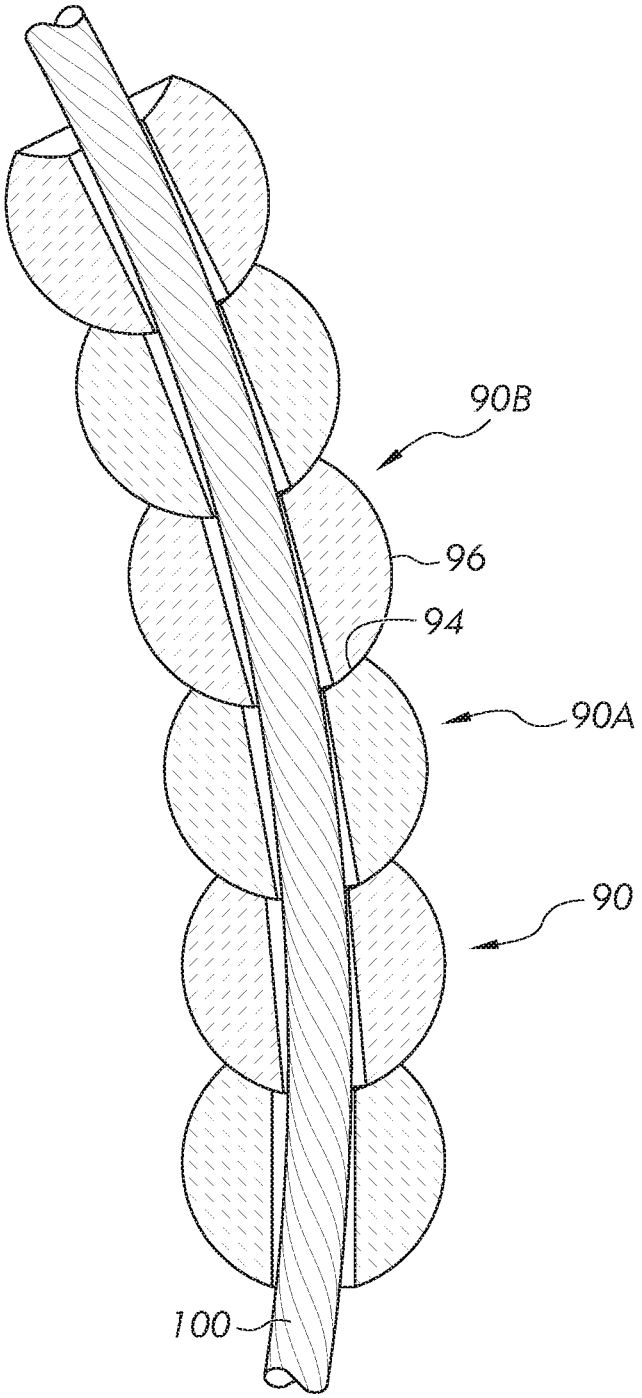
FIG. 11 is a cross-sectional view of a few of the plurality of nested ceramic segments of FIG. 10.

As shown in FIGS. 10 and 11, a rope or cord 100 extends through the bore 92 of each of the segments 90. Each one of a plurality of the segments 90 (ceramic bodies) is located next to another segment 90, such that one of the segments 90 nests with an adjacent segment 90.

For instance a segment 90A is located between a segment 90B and a segment 90C. The surface 96 of one of the segments interfaces with the adjacent surface 94 of an adjacent segment 90. For example, the surface 96 of segment 90B extends into a space defined by the surface 94 of the adjacent segment 90A such that each of the plurality of segments 90 is nested with an adjacent segment 90. In one embodiment, each of the plurality of segments 90 is substantially similar. In this embodiment, therefore, the exterior surface 96 of sphere 90A extends over, or overlaps, the exterior surface 96 of sphere 90B. Depending on the bend of the bend in the ceramic body cable, the surface 94 contacts the surface 96 of an adjacent segment. The combined segments 90 and cord 100 are also called a ceramic body cable 101 having ceramic bodies and a cord.

Figure 12:
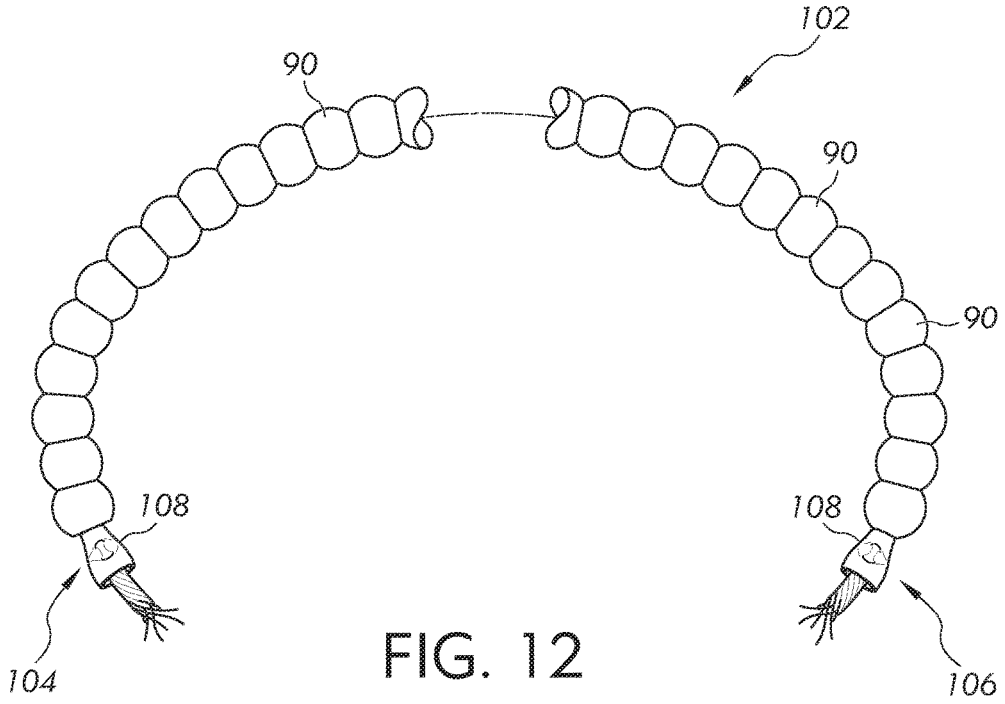
FIG. 12 is a plan view of a cable of a cable lock illustrating the segments of FIG. 9.
Figure 13:
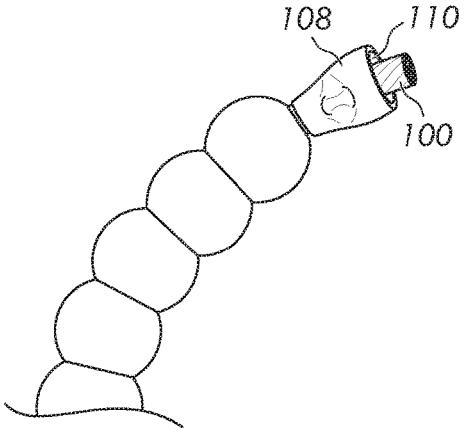
FIG. 13 is a plan view of a crimped end of a cable of a cable lock.
Figure 14:
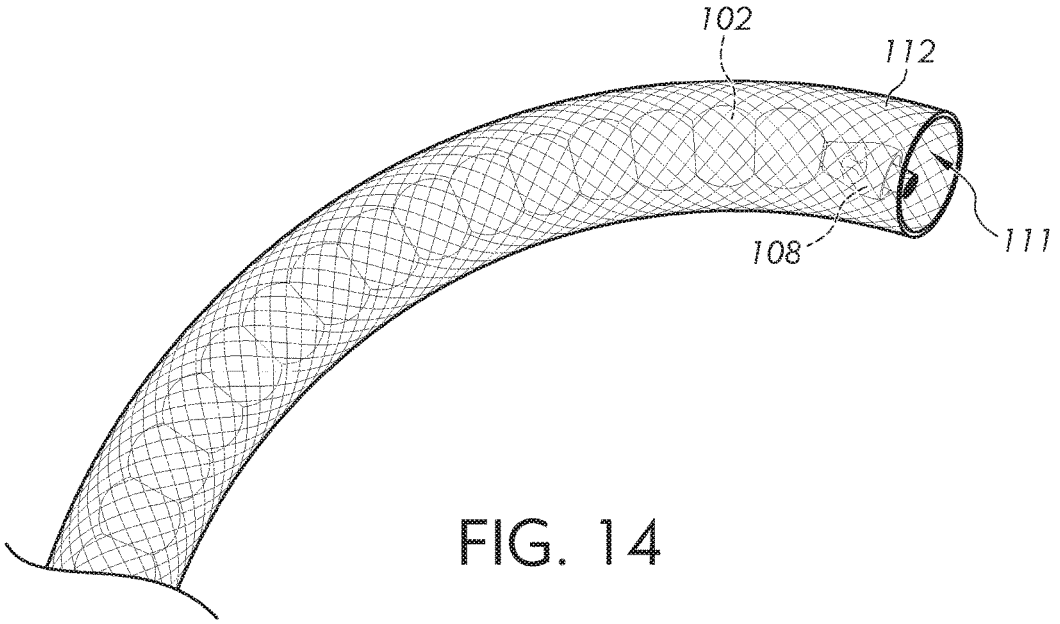
FIG. 14 is a plan view of a sleeve covering the cable of FIG. 12.

FIGS. 12 and 13 illustrate one embodiment of a string 102 of the elements 90 having a first end 104 and a second end 106, each of which includes a crimped sleeve 108. In one embodiment, the crimped sleeve 108 includes a channel 110 which is slid over the rope 100 and which is crimped to collapse the sleeve 108 into direct holding contact with the rope 100. By crimping each of the sleeves 108, the segments 90 are held in direct contact with adjacent segments 90.

Once each of the first end 104 and second end 106 include a crimped sleeve 108, the string 102 is inserted into a channel 111 defined by a braided sleeve 112. In one embodiment, the sleeve is made of polyethylene terephthalate. In other embodiments, other materials are used including nylon, steel, copper, aluminum, and stainless steel. The sleeve 112 is shown as being expanded with respect to the string 102 for purposes of illustration. In different embodiments, the sleeve 112 is in a collapsed condition and insertion of the string 102 expands the sleeve 112. Once the string 102 located in the channel 111, the sleeve 112 stretches around the string 102 for a form fit.

Figure 15:
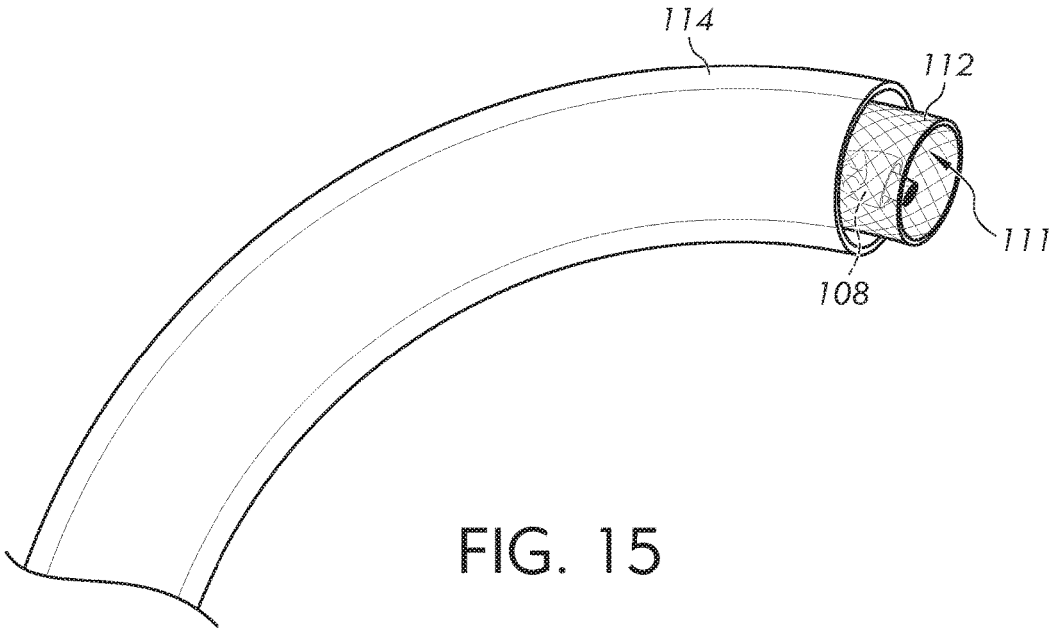
FIG. 15 is a plan view of a shrinkable tube covering the sleeve of FIG. 14.

After the string 102 is located within the sleeve 112, the combined the string 102 and sleeve 112 are inserted into a tube 114 of unshrunk heat shrinkable tubing as shown in FIG. 15. The tube 114 includes a diameter large enough to enable the tube 114 to slide the combined string 102 and sleeve 112, but small enough to shrink to a tight fit when heated. In different embodiments, the tube 114 is made of a thermoplastic material, including but not limited to, polyolefin, fluoropolymer, polylvinyl chloride, neoprene, silicone elastomer, or synthetic rubber.

Figure 16:
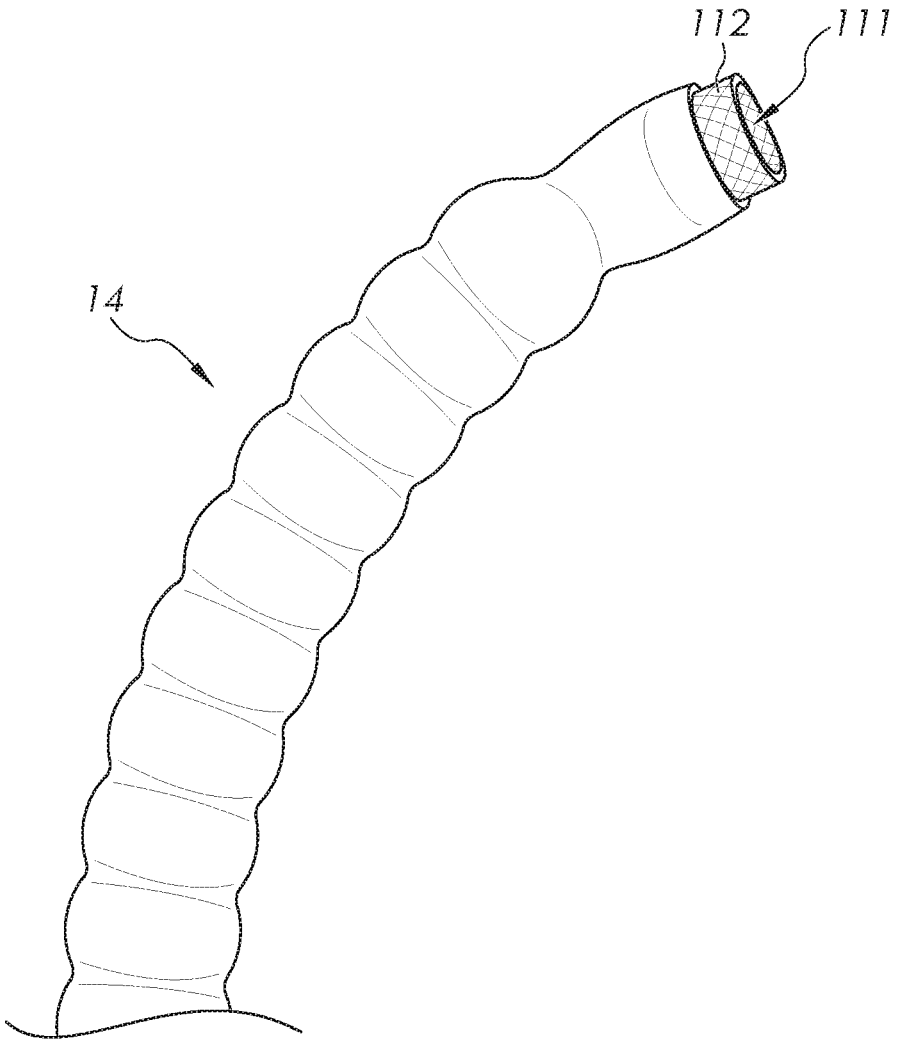
FIG. 16 is a plan view of the shrinkable tube of FIG. 15 after being shrunk around the cable of FIG. 12.

Once heated, as shown in FIG. 16, the tube 114 collapses about the sleeve 112 and conforms to the shapes of the individual segments of the string 102. After the cable 14 is complete, one end is fixedly connected to the collar 17 and the other end is fixedly connected to the collar 24. In one embodiment, the completed cable 14 includes a length of twenty-four inches.

The disclosed embodiments of a cable lock provide increased security while maintaining the necessary flexibility to lock a bicycle to a stand. The cable lock is also easy to use and store transport. The flexible cable lock provides greater protection against attempts to defeat the protection provided by the cable, including attempts using power tools, angle grinders, bolt cutter, and saws. The use of the nested ceramic segments provides an improved deterrent against theft since the interface between adjacent segments is protected by the overlapping features of the segments. For instance, where the segments include projections, the projections act as a shield or barrier to a seam located between adjacent segments.

While the invention has been illustrated and described in detail in the drawings and foregoing description, the same is to be considered as illustrative and not restrictive in character, it being understood that preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A cable lock, comprising:

a lock body including a locking mechanism having a locked state and an unlocked state;

a plurality of ceramic bodies, each including a center portion defining an aperture and a plurality of projections extending from the center portion, wherein each of the ceramic bodies are located adjacent one another, and wherein the plurality of projections of one of the plurality of ceramic bodies overlaps the center portion of each of two adjacently located ceramic bodies; and a cord extending through the aperture of each of the plurality of adjacent ceramic bodies and operatively connected to the lock body.

2. The cable lock of claim 1, wherein the center portion of each of the plurality of ceramic bodies comprises a ring.

3. The cable lock of claim 2, wherein the plurality of projections are equally spaced about the center portion of a respective one of the plurality of ceramic bodies.

4. The cable lock of claim 3, wherein each of the plurality of projections includes a contact surface adapted to bear against the center portion of an adjacent ceramic body.

5. The cable lock of claim 4, wherein the plurality of projections of each of the center portions defines a space between adjacent projections, and wherein the space includes a bearing surface for bearing against the contact surface of an adjacent ceramic body.

6. The cable lock of claim 5, wherein each of the projections comprise a disc.

7. The cable lock of claim 6, wherein each disc defines a diameter that is greater than a height of the center portion.

8. The cable lock of claim 5, wherein each of the projections comprises a fin.

9. The cable lock of claim 8, wherein the fin includes a height greater than a height of the center portion.

10. The cable lock of claim 1, further comprising a mesh sleeve having a channel, and wherein the plurality of ceramic bodies are located in the channel.

11. The cable lock of claim 10, further comprising a heat shrinkable tube, and wherein the mesh sleeve and the plurality of ceramic bodies are located in the heat shrinkable tube.

12. A cable lock, comprising:

a lock body including a locking mechanism having a locked state and an unlocked state;

a ceramic body cable including a plurality of nested ceramic bodies and a cord, each one of the plurality of ceramic bodies including a center portion defining an aperture, wherein the apertures of the plurality of nested ceramic bodies form a channel through which the cord is positioned;

a mesh sleeve positioned on an exterior of the ceramic body cable; and a shrunken heat shrinkable tube positioned over the mesh sleeve;

wherein each of the plurality of nested ceramic bodies includes an overlap portion and a bearing portion in which the overlap portion of a first ceramic body overlaps a bearing portion of a second ceramic body adjacent to the first ceramic body; and wherein the overlap portion of the first ceramic body includes a first part configured to overlap the second ceramic body, and further includes a second portion configured to overlap a third ceramic body adjacent the first ceramic body.

13. The cable lock of claim 12, wherein each of the plurality of nested ceramic bodies comprises a disc including the first part and the second portion.

14. The cable lock of claim 12, wherein each of the plurality of nested ceramic bodies comprises a fin including the first part and the second portion.

15. The cable lock of claim 12, further comprising:

a first crimped sleeve located at a first end of the ceramic body cable; and a second crimped sleeve located at a second end of the ceramic body cable.

16. The cable lock of claim 15, wherein the ceramic body cable, the mesh sleeve, the shrunken heat shrinkable tube, and the crimped sleeves comprise a unitary cable operatively connected to the lock body.

17. The cable lock of claim 16, wherein the lock body includes one of a keyhole, a combination lock, or an electronic lock responsive to a key fob.

18. A method of forming a cable lock, comprising:

providing a plurality of ceramic elements, a cord, a mesh sleeve, a heat shrinkable tube, and a lock body;

threading the cord through the plurality of ceramic elements to form a ceramic body cable, wherein for each ceramic element, there is at least one adjacent ceramic element that both (i) partially overlaps the ceramic element, and (ii) is partially overlapped by the ceramic element;

threading the ceramic body cable through the mesh sleeve;

threading the mesh sleeve and ceramic body cable through the heat shrinkable tube;

shrinking the heat shrinkable tube about the mesh sleeve; and connecting the combined ceramic body cable, mesh sleeve, and shrunken heat shrinkable tube to the lock body.

19. The method of claim 18, wherein each of the plurality of ceramic elements includes a plurality of projections and a plurality of spaces separating the plurality of projections.

20. The method of claim 19, wherein the threading includes threading the cord through the plurality of ceramic elements by aligning the projections of each ceramic element with the spaces of an adjacent ceramic element.

21. The method of claim 18, wherein each of the plurality of ceramic elements includes a plurality of projections having a space disposed between each of the plurality of projections.

22. The method of claim 21, wherein the threading includes threading the cord through the plurality of ceramic elements by aligning each of the plurality of projections of each ceramic element with the space of an adjacent ceramic element.

* * * * *